US006371422B1

(12) United States Patent
St. Martin et al.

(10) Patent No.: US 6,371,422 B1
(45) Date of Patent: Apr. 16, 2002

(54) DEVICE FOR RETAINING A PROTECTIVE PANEL OVER A WINDOW

(76) Inventors: George St. Martin, 304 Lassalle Dr., River Ridge, LA (US) 70123; Jerry G. Baker, 202 Greenwood St., Houma, LA (US) 70364

( * ) Notice: Subject to any disclaimer, the term of this patent is extended or adjusted under 35 U.S.C. 154(b) by 0 days.

(21) Appl. No.: 09/418,878

(22) Filed: Oct. 15, 1999

(51) Int. Cl.[7] ..... E04G 25/00

(52) U.S. Cl. ..... 248/200.1; 52/126.6; 248/354.3; 248/354.5; 410/151

(58) Field of Search ..... 248/200.1, 208, 248/231.2, 354.3, 188.5, 354.1, 354.7, 222.14, 222.13, 224.8, 225.11; 52/126.6, 126.3; 5/662; 410/151, 145; 285/91; 473/429, 483

(56) References Cited

U.S. PATENT DOCUMENTS 741,541 A * 10/1903 Chatfield ..... 248/188.5 X
2,777,174 A 1/1957 Carr
3,519,293 A * 7/1970 Henning et al. ..... 248/200.1
3,976,313 A * 8/1976 Lauffenburger et al. ..... 285/84
4,295,670 A * 10/1981 Goodal et al. ..... 285/91
4,627,591 A * 12/1986 Heckmann ..... 248/411
5,094,576 A * 3/1992 Fredelius ..... 410/151
5,335,452 A 8/1994 Taylor
5,383,315 A 1/1995 Birs
5,400,994 A * 3/1995 Shawwaf et al. ..... 248/354.3
5,507,118 A 4/1996 Brown
5,558,501 A * 9/1996 Wang et al. ..... 248/200.1 X
5,586,352 A * 12/1996 O'Brien et al. ..... 5/662
5,590,863 A * 1/1997 Sasaki ..... 248/354.3
5,673,883 A * 10/1997 Figueroa, Jr. et al. ... 248/200.1
5,758,854 A * 6/1998 Shih ..... 248/354.3
5,813,647 A * 9/1998 Chen ..... 248/354.7
5,819,482 A * 10/1998 Belke et al. ..... 52/126.6
5,862,635 A * 1/1999 Linse et al. ..... 52/126.6
5,897,085 A * 4/1999 Cronin ..... 248/200.1
5,979,854 A * 11/1999 Lundgren et al. ..... 248/354.3

* cited by examiner

*Primary Examiner*—Ramon O. Ramirez
*Assistant Examiner*—Tan Le
(74) *Attorney, Agent, or Firm*—Kenneth L Tolar

(57) ABSTRACT

A length adjustable bar for mounting within a window opening to secure a protective panel therein includes a substantially hollow outer section having an inner section telescopingly received therein. A plurality of gear teeth are longitudinally disposed on the inner section. A cam is pivotally mounted to the outer section and includes gear teeth thereon that interengage the gear teeth on the inner section when the cam is rotated to a first position. The cam is rotated with a handle having an aperture thereon that aligns with apertures on a pair of spaced tabs when the cam is placed in the first position to receive a locking means to fix the bar at a select length. The design allows the bar to be extended to substantially the same length or width of the window opening. By pivoting the handle downwardly, the geared cam extends the inner section slightly to tightly wedge the bar within the opening.

4 Claims, 3 Drawing Sheets

DEVICE FOR RETAINING A PROTECTIVE PANEL OVER A WINDOW

BACKGROUND OF THE INVENTION

The present invention relates to an adjustable bar for securing a protective panel over a window.

DESCRIPTION OF THE PRIOR ART

During severe storms, especially hurricanes, protective coverings such as plywood panels are typically mounted over exposed, external windows to protect the windows from flying debris or high winds. The plywood panels are typically fastened to the area surrounding the window with nails or screws which is time consuming and laborious. Furthermore, the nails and screws cause damage to the building. The present invention overcomes the disadvantages associated with installing such protective panels by providing a variable length bar which may be mounted securely within a window opening to maintain a protective panel therein.

At least one length adjustable device for securing a protective panel over a window exists in the prior art. For example, U.S. Pat. No. 5,673,883 issued to Figueroa, Jr. relates to a bar device for installing a protective sheet over a window. The device includes a turnbuckle having a rod threaded to each of two ends thereof, each rod having a pad at a distal end. The rods further include a threaded bolt perpendicularly extending therefrom each of which is secured to the protective sheet.

U.S. Pat. No. 5,507,118 issued to Brown relates to a window guard including a board and an X-shaped brace pivotally mounted thereon which cooperates with holes in the window frame.

U.S. Pat. No. 5,383,315 issued to Birs relates to a hurricane shutter reinforcement and method.

U.S. Pat. No. 5,335,452 issued to Taylor relates to a hurricane panel apparatus including a panel member secured within an opening with a transverse beam across the panel that fits within pairs of spaced leg members.

U.S. Pat. No. 2,777,174 issued to Carr relates to a storm shutter.

Although the patent issued to Figueroa, Jr. discloses a length adjustable bar that can be secured within a window opening, the bar must be bolted to the protective panel which is laborious and time consuming. Furthermore, to adjust the length of the device, one or both rods must be rotated relative to the turnbuckle which is likewise time consuming and inconvenient. The present invention provides a telescoping bar having a locking means that locks the bar at a desired length. The locking means, when actuated, also extends the bar slightly to tightly wedge it between two opposing portions of the window opening.

SUMMARY OF THE INVENTION

The present invention relates to an adjustable bar assembly which may be tightly secured within a window opening to retain a protective panel therein. The device includes an elongated outer hollow section with an elongated inner section telescopingly received therein. The inner section includes a plurality of gear teeth longitudinally disposed thereon. A cam having peripherally disposed gear teeth is pivotally mounted to the outer section. A handle rotates the cam teeth into engagement with the teeth on the inner section thereby extending the inner section relative to the outer section. A locking device locks the handle to maintain the bar sections in a fixed relationship. It is therefore an object of the present invention to provide a device which assists a user in quickly and conveniently installing a protective panel over a window.

It is another object of the present invention to provide a device for retaining a protective panel within a window opening that is length adjustable to fit within varying size window openings.

It is yet another object of the present invention to provide a length adjustable device for securing a protective panel within a window opening having an extension/locking means to tightly secure said device therein. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
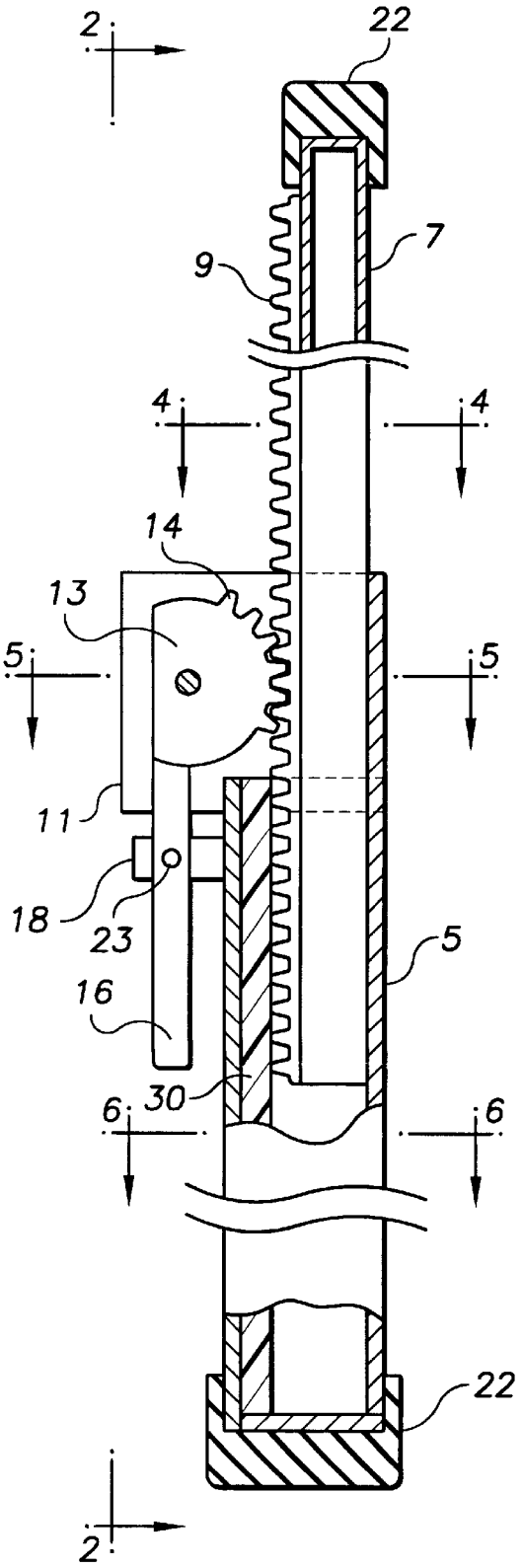
FIG. 1 is a elevational, sectional, partial cut away view of a first side of the invention.
Figure 2:
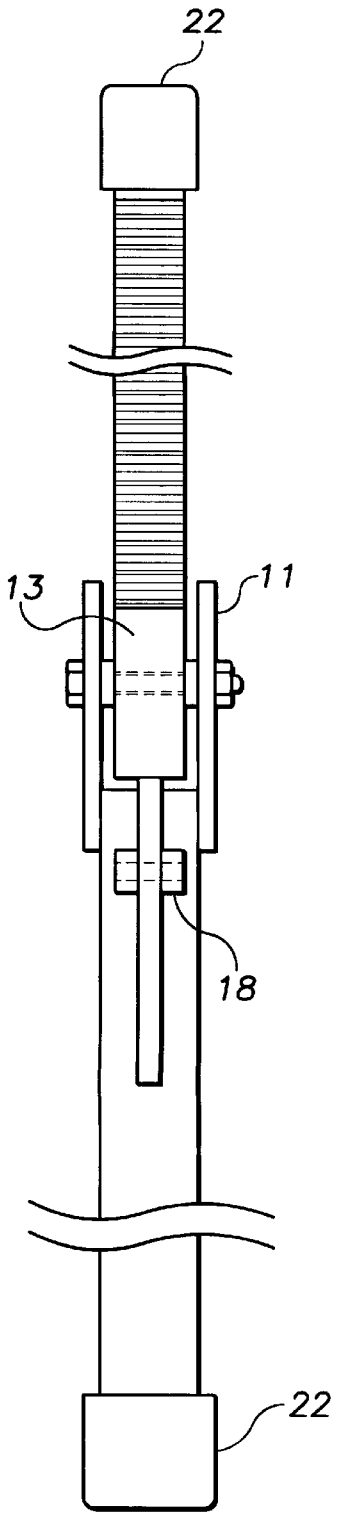
FIG. 2 is a front view shown by lines 2—2 of FIG. 1.

Referring now to FIGS. 1 through 8, the present invention relates to an elongated, length adjustable bar for mounting within a window opening 1 to retain a protective panel 2, such as plywood, therein. An external window opening is typically defined by a rectangular border 21. The bar according to the present invention comprises a hollow outer section 5 having a open top end with an inner section 7 telescopingly received therein. The inner section includes a front surface having a plurality of gear teeth 9 longitudinally disposed along substantially the entire length thereof. The outer section also includes an axial passageway defined by a plurality of inner walls within which the inner section slides. Overlaying one of the inner walls is a layer 30 of rubber, plastic or a similar material that provides a smooth surface on which the inner section slides into and out of the outer section.

Outwardly extending from the outer section are a pair of spaced plates 11 with a cam 13 pivotally mounted therebetween using a bolt 35 or similar fastener. The cam includes a plurality of peripherally disposed gear teeth 14 thereon for selectively interengaging the gear teeth 9 on the inner section to extend and retract the sections or to lock the sections in a fixed relationship.

Figure 3:
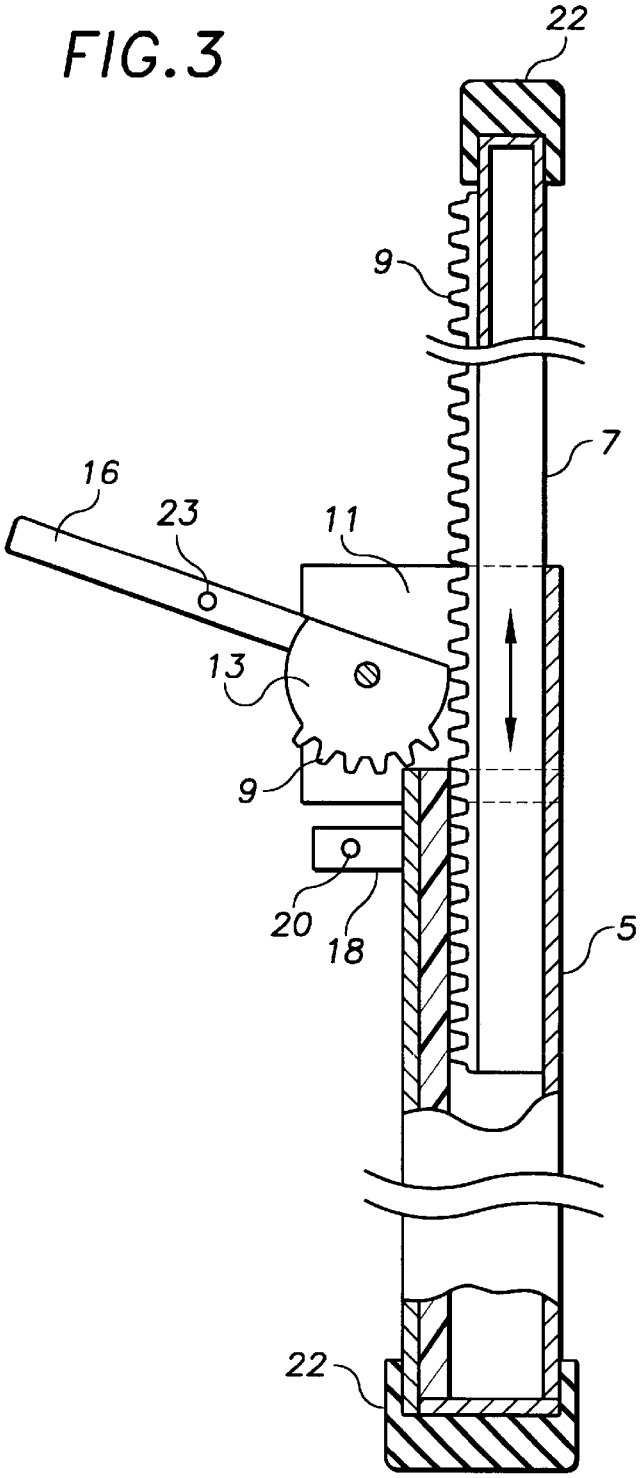
FIG. 3 is an elevational sectional view of FIG. 1 depicting the lever in a non-engaged position.
Figure 4:
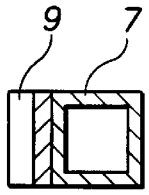
FIG. 4 is a cross-sectional view taken along lines 4—4 of FIG. 1.
Figure 5:
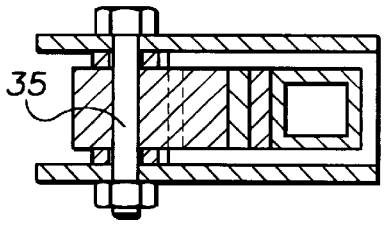
FIG. 5 is a cross-sectional view taken along lines 5—5 of FIG. 1.
Figure 6:
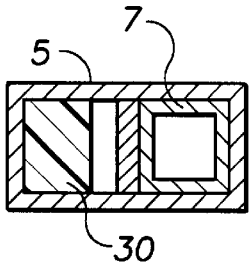
FIG. 6 is a cross-sectional view taken along lines 6—6 of FIG. 1.
Figure 8:
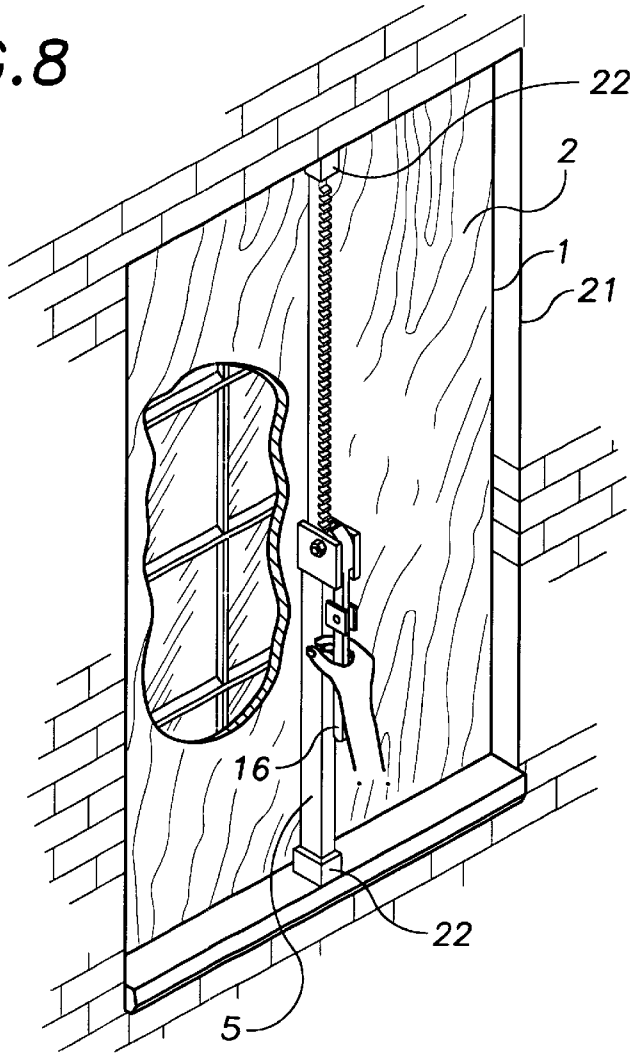
FIG. 8 is a perspective view of the device secured within a window opening.
Figure 7:
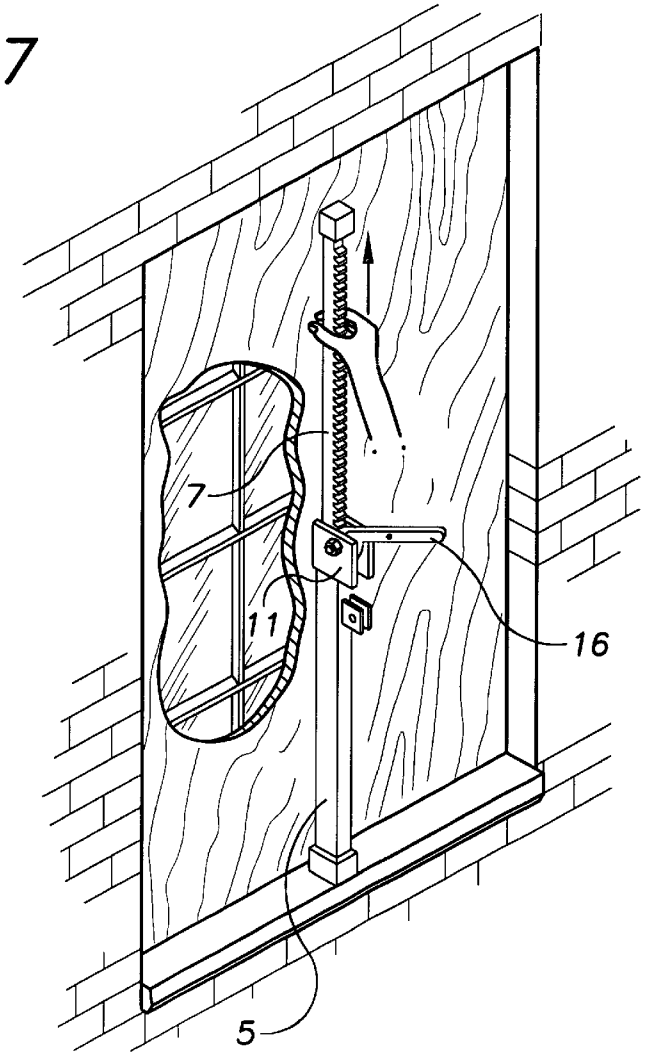
FIG. 7 is a perspective view of the device installed within a window opening with the lever in a non-engaged position.

Rotating the cam between a disengaged position as depicted in FIGS. 3 and 7, and an engaged position as depicted in FIG. 8, extends the inner section slightly so that the bar can be wedged within a window opening. Extending from the cam is an elongated handle 16 having an aperture 22 therethrough that is grasped to rotate the cam between the engaged and disengaged positions.

Likewise extending from the outer section and positioned beneath the spaced plates are a pair of spaced tabs 18 each having an aperture 20 therethrough. The tabs are positioned such that the apertures will align with the aperture on the handle when the handle is positioned between the tabs. Accordingly, a locking means such as a pin or padlock can be inserted into the aligned apertures to fix the bar at a selected length. The distal end of each bar section includes a padded foot 22 disposed thereon formed of a slightly compressible material such as rubber to minimize damage to the window opening border. The compressible pads also allow the bar to be extended slightly by pivoting the handle downwardly when the pads are firmly placed against opposing sides of the window opening border thereby tightly wedging the bar therebetween.

To use the above described device, the handle is pivoted to place the cam in a disengaged position as depicted in FIGS. 3 and 7. A protective panel such as a sheet of plywood or similar material is placed within the window opening and over the window. The bar is placed within the window opening, preferably in a horizontal position. The bar is manually extended until each foot tightly engages one of two opposing portions of the window opening border. The handle is then pivoted downwardly causing the cam to rotate towards the engaged position. As the cam teeth rotatably engage the teeth on the inner section, the inner section is extended slightly. The pads will each be thrust against the border and will be compressed slightly thereagainst whereby the bar is tightly wedged within the opening. The aperture on the handle is aligned with the apertures on the spaced tabs and a pin or padlock is inserted therethrough to lock the bar at the selected length.

The above described device is preferably constructed with aluminum, steel, stainless steel or similar equivalent. However, as will be readily apparent to those skilled in the art, the size, shape and materials of construction may be varied without departing from the scope of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a window opening, said window opening defined by a border, said opening having a window therein and a protective panel overlaying said window, a device for retaining said protective panel within said window opening consisting of:

an outer section;

an inner section telescopingly received within said inner section, said inner section having a plurality of gear teeth longitudinally disposed thereon;

a cam pivotally attached to said outer section, said cam having peripherally disposed gear teeth thereon that engage said teeth on said inner section to extend and lock said inner section relative to said outer section when said cam is rotated to a first position, said teeth retracting said inner section and disengaging said teeth on said inner section when said cam is pivoted to a section position;

means for locking said cam in said first position.

2. The combination according to claim 1 wherein said means for locking said cam in said first position consists of:

a handle extending from said cam, said handle having an aperture thereon;

a pair of spaced tabs extending from said outer section, each tab having an aperture thereon, said tab apertures aligning with said handle aperture when said cam is placed in the first position;

a locking means received within said tab and handle apertures when said apertures are aligned for locking said inner and outer sections in a fixed relationship.

3. The device according to claim 2 wherein said inner and outer sections each include a distal end having a compressible foot pad mounted thereon, one of said pads engaging a first portion of said window opening and the other of said foot pads engaging an opposing portion of said window opening.

4. A method of securing a protective panel within a window opening consisting of:

placing a protective panel in a window opening with said panel overlaying a window;

placing a telescoping bar within said window opening and against said panel, said bar having at least two sections, one section having a cam thereon that interengages linear teeth on the other section, said cam having a handle extending therefrom;

extending said bar until each end of said bar engages a portion of said window opening;

pivoting said handle in a first direction to further extend said bar to tightly wedge said bar within said opening;

locking said handle to fix said bar in an extended position.

* * * * *

UNITED STATES PATENT AND TRADEMARK OFFICE

CERTIFICATE OF CORRECTION

PATENT NO. : 6,371,422 B1 
DATED : April 16, 2002
INVENTOR(S) : St. Martin, George and Baker, Jerry G.

It is certified that error appears in the above-identified patent and that said Letters Patent is hereby corrected as shown below:

Title page,
Item [73], insert the following:

-- [73] Assignee: George. St. Martin, River Ridge, LA --.

Signed and Sealed this

Ninth Day of July, 2002

*Attest:*

*Attesting Officer*

JAMES E. ROGAN
*Director of the United States Patent and Trademark Office*